US005246565A

United States Patent [19]

Mignardot

[11] Patent Number: 5,246,565

[45] Date of Patent: Sep. 21, 1993

[54] HIGH ADHERENCE COPPER PLATING PROCESS

[75] Inventor: Henry Mignardot, Tesuque, N. Mex.

[73] Assignee: The United States of America as represented by the United States Department of Energy, Washington, D.C.

[21] Appl. No.: 881,025

[22] Filed: May 7, 1992

[51] Int. Cl.[5] ..... C25D 5/10; C25D 5/36; C25D 5/44

[52] U.S. Cl. ..... 205/181; 205/182; 205/185; 205/213; 205/217; 205/222; 205/917

[58] Field of Search ..... 205/181, 182, 185, 206, 205/213, 217, 222, 917

[56] References Cited

U.S. PATENT DOCUMENTS

| | | | |
|---|---|---|---|
| 2,891,309 | 6/1959 | Fenster | 205/185 X |
| 3,881,999 | 5/1975 | Toth et al. | 205/185 X |
| 3,989,606 | 11/1976 | Kampert | 204/38 B |
| 4,115,211 | 9/1978 | Tsukamoto | 204/37 R |
| 4,169,770 | 10/1979 | Cooke et al. | 204/28 |
| 4,316,778 | 2/1982 | Whitehurst | 204/5 |
| 4,346,128 | 8/1982 | Loch | 427/328 |
| 4,670,312 | 6/1987 | Ehrsam | 427/438 |
| 4,904,354 | 2/1990 | Stavitsky et al. | 204/40 |

OTHER PUBLICATIONS

F. A. Lowenheim, *Electroplating*, McGraw-Hill Book Co., New York, 1978, pp. 67-92.

Metal Finishing Guidebook & Directory for 1975, Metals and Plastics Publication; Inc., Hackensack, N.J., 1975, pp. 144-163.

Henry Mignardot et al., "Copper Plating The Ground Test Accelerator RFQ," pp. 777-779 of vol. 2 of the proceedings of the 1991 IEEE Particle Accelerator Conference, which was published by the Institute of Electrical and Electronics Engineers of New York, N.Y.

*Primary Examiner*—John Niebling
*Assistant Examiner*—William T. Leader
*Attorney, Agent, or Firm*—Richard J. Cordovano; Paul D. Gaetjens; William R. Moser

[57] ABSTRACT

A process for applying copper to a substrate of aluminum or steel by electrodeposition and for preparing an aluminum or steel substrate for electrodeposition of copper. Practice of the invention provides good adhesion of the copper layer to the substrate.

4 Claims, No Drawings

HIGH ADHERENCE COPPER PLATING PROCESS

This invention is the result of a contract with the Department of Energy (Contract No. W-7405-ENG-36).

BACKGROUND OF THE INVENTION

This invention relates to the field of electrochemistry and, more particularly, to electrodeposition of metals.

The ground test accelerator program at Los Alamos National Laboratory utilizes a radio frequency quadrupole (RFQ) through which a particle beam passes. A large quantity of RF power is added to this RF cavity, which is operated at cryogenic temperatures (20–50 K.). It is desirable to fabricate the RFQ of aluminum having a thin coating of copper. However, the coefficient of thermal expansion of aluminum is different from that of copper, so that cooling an aluminum article having a copper coating from room temperature to a cryogenic temperature and back to room temperature promotes delamination at the aluminum/copper interface. The present invention provides a solution to this delamination problem and will be useful in other applications where good adhesion of a copper layer to a substrate is required.

Aluminum articles having dimensions similar to those of components of the RFQ were coated with thin layers of copper by prior art electrodeposition processes and subjected to cycling between room temperature and the temperature of liquid helium (35 K.). It was observed that the copper layers separated from the aluminum substrates. Bubbles formed on the surface of the copper and the copper layer detached from the aluminum at the edges of the articles, even though no mechanical stresses were applied to the coated test articles. Thus, it was necessary to develop a process which provides better adherence between a substrate and a layer of electrodeposited copper. Articles which were copper coated using the process did not delaminate when subjected to cycling between room temperature and 20 K. and scratch and peel tests did not result in separation of the copper layer from the substrate.

SUMMARY OF THE INVENTION

A process for applying copper to a substrate of aluminum or steel by electrodeposition and for preparing an aluminum or steel substrate for electrodeposition of copper. Practice of the invention provides good adhesion of the copper layer to the substrate.

DETAILED DESCRIPTION OF THE INVENTION

The process used to copper plate aluminum test articles and the RFQ is described in the following paragraphs. The surface finish quality of the RFQ, before plating, was about 50 microinch. An article was cleaned using Northwest Alkalume 141 in a concentration of about 6 to 8 ounces/gallon in water at 155°–160° F. and clear water for rinsing. There are numerous soaps, detergents, and industrial cleaners which may also be used. An alkaline cleaning should be used; that is, the cleaning agent should be alkaline rather than acidic.

The article was then dipped in an activation bath for pickling, or etching, the article and removing silica particles and other foreign material, such as oxides and heat treat discoloration. The activation bath consisted of 25 vol % water, 50 vol % nitric acid, and 25 vol % sulfuric acid with ammonium bifluoride added in an amount of one pound per gallon of the acid solution. The ammonium bifluoride is effective in removing silica and it is expected that the amount used may be varied from about ½ to about 3 pounds/gallon. Alternatively, a commercially available product, Enthone Actane 70, may be added to an acid solution to provide concentrations similar to those of the ammonium bifluoride. The activation bath composition may be varied and may contain from about 10 to about 50 vol % water, with the balance consisting of acid. The acid portion of the bath may contain from about 40 to about 95 vol % nitric acid and from about 5 to about 60 vol % sulfuric acid. The temperature of the activation bath was maintained in the range of from about 70° to about 90° F., though it is expected that temperatures in a range of about 65°–100° F. may be used. Etch rate depends on temperature and concentration of the activation bath; higher temperature are more effective and lower concentrations provide more control.

The article was then rinsed in clear water and dipped in a 50 vol % nitric acid/water bath to oxidize any foreign material on the article. The nitric acid concentration may vary from about 40 vol % to about 60 vol % and temperature may vary between 65°–95° F. After the nitric acid dip, the article was rinsed in clear water.

The article was then immersed in a sodium zincate solution for about 10 seconds. The immersion time may vary from about 10 to about 15 seconds. A function of the zincate is to prevent oxidation of the aluminum. The zincate immersion provides a very thin zinc film which facilitates subsequent plating. However, there is no distinct zinc layer on the finished article, though zinc is detectable by appropriate methods of analysis. The zincate bath consisted of from about 20 to about 30 vol % of Allied Kelite ARP 302ZN in water. Allied Kelite is located in Melrose Park, Ill. and is a division of Witco Co. Other zincating solutions may be used, such as one pound/gallon of water of Enthone Alumon D or a water solution containing 525 g/L of NaOH and 100 g/L of zinc oxide. Another recipe is, in ounces per gallon of water, 70 of NaOH, 30 of zinc oxide, 0.13 of ferric chloride, and 1.3 of Rochelle salts. Generally, these concentrations may be varied in a plus or minus 50% range. The zincating solution temperature was about 160°–180° F., but may be varied between from about 70° to about 180° F.

The article was then dipped in a 50 vol % nitric acid/water bath (range may be about 40–60 vol %, temperature 65°–95° F.) for removal of excess zinc and then in a zincating solution as described above for about 40 seconds. The immersion time in the zincate may vary from about 30 to about 40 seconds.

The article was then immersed in an electrolysis nickel bath for about 20–30 minutes to electroplate a layer of nickel having a thickness of about 0.0002 inch onto the article. It is expected that a thickness of from about 0.0001 to about 0.0003 inch will be effective in promoting good adherence in accordance with the present invention. Bath temperature was about 185° F.; the preferred range is 170°–190° F. and it is expected that temperatures in a range of about 100°–200° F. may be used. The nickel plating bath utilized Allied Kelite Niklad 794. Other bath compositions may be used, such as a standard mid-phosphorus nickel electrolysis bath or a bath containing nickel chloride and HCl. The deposition rate may be varied from about 0.0012 to about 0.0042 inch/hour. The nickel layer is critical to the invention. Articles plated by use of the inventive process but omitting the nickel plating step showed separation of the copper layer from the substrate when subjected to a scratch and peel test. A function of the nickel layer is to provide a more uniform surface for acceptance of the copper strike layer.

After plating of the nickel layer, a copper strike process was employed to deposit a copper layer of about 0.0002 inch thickness on the article. It is expected that a thickness of from about 0.0001 to about 0.0003 inch will be effective in promoting good adhesion. The copper strike electroplating solution recipe which was used consisted of, in ounces per gallon of water, 1.5 of copper, 0.7 of sodium cyanide, and 6 of sodium potassium tartrate. Preferred ranges, in ounces per gallon, are 1-2 copper 0.7-1.5 of sodium cyanide, and 4-8 of sodium potassium tartrate. Other copper strike bath recipes may be used. The pH of the bath was maintained at about 11.0 by adding NaOH to the bath; the preferred pH range is about 10-12. The temperature was about 110° F.; it is expected that temperatures in a range of from about 100° to about 130° F. may be used. Plating time was 20-30 minutes. The plating rate may be varied from about 0.0012 to about 0.0042 inch/hour. One function of the copper strike layer is to serve as a grain refiner for the second layer of copper. The major differences between a copper strike plating solution and a copper plating solution is the concentration of copper in the solution and that the copper strike bath is alkaline while the plating bath is acid.

The article was then treated, or abraded, with an abrasive material to smooth it and remove excess copper strike. White Dot Pumice Scrub was used. The abrasive was placed on the article and then the article was wet-scrubbed with a stiff natural-bristle brush. It was found that immersion in a mildly agitated bath of pumice and water did not sufficiently smooth the surface and, for that reason, manual scrubbing was used. A more violently agitated pumice bath may be used or a pumice/water stream may be directed at an article by means of a hose. After the abrasive treatment, the article was thoroughly washed to remove pumice. Then, the article was dipped into a 10 vol % sulfuric acid/water mix at room temperature. Acid strength may vary between about 10-30 vol % and temperature between about 65°-90° F. Purposes of this dip are to remove pumice and copper oxide and reactivate the copper strike layer, putting it into an acid condition.

The deposition of the surface layer of copper having a thickness of 0.0006 inch was then accomplished by electroplating in a bright acid copper electrolysis bath. Bath temperature was about 85° F.; a preferred range is 75°-95° F. and it is expected that temperatures in a range of from about 65° to about 100° F. may be used. A bath recipe which may be used is from about 20 to about 32 ounces per gallon of water of copper sulfate, from about 6 to about 12 ounces per gallon of sulfuric acid, from about 40 to about 100 ppm by weight of HCl, about 4-10 wt % of a make-up brightener, and from about 1 to about 2 wt % of a maintenance brightener. The baths for the articles which were plated utilized electrolyte recipes having initial component compositions within these ranges. Preferred amounts are: copper sulfate-25, $H_2SO_4$-9, HCl-60, make-up brightener-5, and maintenance brightener-1. The brighteners used are proprietary compositions obtained from OMI International Corp. of Warren, Mich. The recipes used are variations of the OMI Udylite UBAC 2X Bright Acid Copper Plating Process, which is normally used for electroplating onto substrates of steel or zinc. Other copper plating processes in addition to the UBAC 2X process may be used and the copper layer may be of any desired thickness. The current flow used for plating the second layer of copper and for the nickel and copper strike layers is adjusted according to consideration of the deposition rate which is desired, the area of the article, and the plating efficiency. In plating the test articles and the RFQ, direct current was used and the voltage range of the electroplating power supply apparatus was set at 1-12 volts. Current density used was about 22 amps per square inch; the preferred range for operation is from about 10 to about 25. During plating, it is recommended that continuous filtration through diatomaceous earth be used and bath agitation is normally provided.

Copper plating of substrates of steel and stainless steels with good adhesion may be accomplished by modifying the above-described process for aluminum substrates as follows. The composition of the activation bath would be from about 20 to about 50 vol % of HCl or $H_2SO_4$ in water. A rinse of the article in clear water after the activation bath step would be added. Also, the first zincate immersion, the following nitric acid dip, and the second zincate immersion would be eliminated.

Electrodeposited bright copper is distinguishable from conventional electrodeposited copper in that bright copper is a bright, lustrous almost mirror-like material which is smoother and harder and has a smaller grain size than conventional electrodeposited copper. Bright copper may be obtained by adding substances called brighteners to conventional copper deposition baths. The present invention is expected to be useful in improving adhesion of conventional electrodeposited copper as well as bright copper layers and is not limited to use in electrodeposition of bright copper or to use with the bath recipes described above.

Thickness of electrodeposited layers was measured using the beta backscatter principle in accordance with ASTM Standard B567. The measuring apparatus was purchased by Twin City International of North Tonawanda, N.Y. and was designated as model TC 1600. Mechanical measurement methods were also used.

Dipping an article in a bath refers to placing it into the bath, submerging it, and then withdrawing it from the bath, without the article remaining in the bath for a time period. When an article is immersed in a bath, the immersion time period refers to the time for which the article is completely submerged. A step comprised of a dip may be changed to an immersion step by changing bath composition and temperature, making them of lower magnitude. Water rinsing steps may or may not be used between steps of the inventive process in order to prevent carry-over of material from bath to bath. The term article means any object to which this process is applied, including an RFQ.

Further information on this invention may be found in a paper by Henry Mignardot and Joseph Uher entitled, "Copper Plating The Ground Test Accelerator RFQ," which may be found on pages 777-779 of volume 2 of the proceedings of the 1991 IEEE Particle Accelerator Conference, which was published by The Institute of Electrical and Electronics Engineers of New York, N.Y.

What is claimed is:

1. A process for applying a highly-adherent coating of copper to an aluminum article, said process comprising:

a. alkaline cleaning an article fabricated of aluminum;
b. dipping said article in an activation bath;
c. dipping the article in a nitric acid and water bath;
d. immersing the article in a zincating solution for from about 10 to about 15 seconds;
e. dipping the article in a nitric acid and water bath;
f. immersing the article in a zincating solution for from about 30 to about 40 seconds;
g. forming a layer of nickel having a thickness of from about 0.0001 to about 0.0003 inch on the article by means of electroplating;
h. forming a layer of copper having a thickness of from about 0.0001 to about 0.0003 inch on the article by means of electroplating;
i. treating the article using abrasive material;
j. dipping the article in a sulfuric acid and water bath; and
k. forming a layer of copper on the article by electroplating.

2. A process for applying a highly-adherent coating of copper to a steel article, said process comprising:

a. alkaline cleaning an article fabricated of steel;
b. dipping said article in an activation bath;
c. rinsing the article using water;
d. forming a layer of nickel having a thickness of from about 0.0001 to about 0.0003 inch on the article by means of electroplating;
e. forming a layer of copper having a thickness of from about 0.0001 to about 0.0003 inch on the article by means of electroplating;
f. treating the article using abrasive material;
g. dipping the article in a sulfuric acid and water bath; and
h. forming a layer of copper on the article by electroplating.

3. A method for preparing an aluminum substrate for electroplating onto it a highly-adherent coating of copper, said process comprising:

a. alkaline cleaning an article fabricated of aluminum;
b. dipping said article in an activation bath;
c. dipping the article in a nitric acid and water bath;
d. immersing the article in a zincating solution for from about 10 seconds to about 15 seconds;
e. dipping the article in a nitric acid and water bath;
f. immersing the article in a zincating solution for from about 30 to about 40 seconds;
g. forming a layer of nickel having a thickness of from about 0.0001 to about 0.0003 inch on the article by means of electroplating;
h. forming a layer of copper having a thickness of from about 0.0001 to about 0.0003 inch on the article by means of electroplating;
i. treating the article using abrasive material; and
j. dipping the article in a sulfuric acid and water bath.

4. A method for preparing a steel substrate for electroplating onto it a highly-adherent coating of copper, said process comprising:

a. alkaline cleaning an article fabricated of steel;
b. dipping said article in an activation bath;
c. rinsing the article using water;
d. forming a layer of nickel having a thickness of from about 0.0001 to about 0.0003 inch on the article by means of electroplating;
e. forming a layer of copper having a thickness of from about 0.0001 to about 0.0003 inch on the article by means of electroplating;
f. treating the article using abrasive material; and
g. dipping the article in a sulfuric acid and water bath.

* * * * *